US010026601B2

(12) United States Patent
Goedecke

(10) Patent No.: US 10,026,601 B2
(45) Date of Patent: Jul. 17, 2018

(54) REFLECTORS FOR TIME-OF-FLIGHT MASS SPECTROMETERS HAVING PLATES WITH SYMMETRIC SHIELDING EDGES

(71) Applicant: Bruker Daltonik GmbH, Bremen (DE)

(72) Inventor: Niels Goedecke, Achim (DE)

( * ) Notice: Subject to any disclaimer, the term of this patent is extended or adjusted under 35 U.S.C. 154(b) by 195 days.

(21) Appl. No.: 14/751,342

(22) Filed: Jun. 26, 2015

(65) Prior Publication Data

US 2016/0005583 A1 Jan. 7, 2016

(30) Foreign Application Priority Data

Jul. 3, 2014 (DE) ..... 10 2014 009 900

(51) Int. Cl.
*H01J 49/40* (2006.01)
*H01J 49/22* (2006.01)

(52) U.S. Cl.
CPC ..... *H01J 49/22* (2013.01); *H01J 49/403* (2013.01); *H01J 49/405* (2013.01)

(58) Field of Classification Search
CPC ..... H01J 49/405; H01J 49/403
See application file for complete search history.

(56) References Cited

U.S. PATENT DOCUMENTS 2,945,972 A * 7/1960 Blue ..... H01J 27/04 250/426
5,811,935 A * 9/1998 Pinker ..... H01J 61/06 313/574
5,955,730 A * 9/1999 Kerley ..... H01J 49/405 250/287
5,994,695 A * 11/1999 Young ..... H01J 49/405 250/287
6,384,410 B1 5/2002 Kawato
6,858,839 B1 * 2/2005 Anderson ..... H01J 49/06 250/281
8,314,381 B2 11/2012 Bisling
2008/0087841 A1 * 4/2008 Verbeck ..... H01J 49/0018 250/396 R
2011/0186730 A1 8/2011 Bisling
2015/0371840 A1 * 12/2015 Park ..... H01J 49/063 250/396 R

FOREIGN PATENT DOCUMENTS

DE 69906935 T2 11/2003
DE 102010039030 A1 2/2012
EP 2355129 A1 8/2011
WO 0111660 A1 2/2001

* cited by examiner

*Primary Examiner* — Brooke Purinton
(74) *Attorney, Agent, or Firm* — Benoit & Côté Inc.

(57) ABSTRACT

The invention relates to reflectors for time-of-flight mass spectrometers, and especially their design. A Mamyrin reflector is provided which consists of metal plates with cut-out internal apertures, and symmetric shielding edges which are set back from the inner edges. The dipole field formed by these shielding edges penetrates only slightly through the plates and into the interior of the reflector. With a good mechanical design, the resolving power of the time-of-flight mass spectrometer increases by around fifteen percent compared to the best prior art to date.

20 Claims, 4 Drawing Sheets

REFLECTORS FOR TIME-OF-FLIGHT MASS SPECTROMETERS HAVING PLATES WITH SYMMETRIC SHIELDING EDGES

BACKGROUND OF THE INVENTION

Field of the Invention

This invention relates to reflectors for time-of-flight mass spectrometers, and especially their design.

Description of the Related Art

Instead of the statutory "unified atomic mass unit" (u), this document uses the "dalton" (Da), which was added in the last (eighth) edition of the document "The International System of Units (SI)" of the "Bureau International des Poids et Mesures" in 2006 on an equal footing with the atomic mass unit. As is noted there, this was done primarily in order to allow use of the units kilodalton, millidalton and similar.

In the prior art, there are essentially two types of high-resolution reflector time-of-flight mass spectrometers, which are characterized according to the way the ions are injected.

Time-of-flight mass spectrometers with axial injection include mass spectrometers which operate with ionization by matrix-assisted laser desorption (MALDI). They usually have Mamyrin reflectors ("The mass-reflectron, a new non-magnetic time-of-flight mass spectrometer with high resolution", Sov. Phys.-JETP, 1973: 37(1), 45-48) in order to temporally focus ions which have an energy spread. Mamyrin reflectors allow second-order temporal focusing of ions of the same mass but with slightly different kinetic energies. Since point ion sources are used in MALDI ionization, the reflectors can be gridless, as a modification of the Mamyrin reflectors, which are operated with grids in order to limit the fields. MALDI-TOF MS are operated with a delayed acceleration of the ions in the adiabatically expanding laser plasma and with high accelerating voltages of up to 30 kilovolts; in good embodiments, with a total flight path of around 2.5 meters, they achieve mass resolution of R=50,000 in a mass range of around 1000 to 3000 daltons.

Time-of-flight mass spectrometers in which a primary ion beam undergoes pulsed acceleration at right angles to the original direction of flight of the ions are termed OTOF-MS (orthogonal time-of-flight mass spectrometers). FIG. 1 depicts a simplified schematic of such an OTOF-MS. The mass analyzer of the OTOF-MS has a so-called ion pulser (12) at the beginning of the flight path (13), and this ion pulser accelerates a section of the low-energy primary ion beam (11), i.e., a string-shaped ion packet, into the flight path (13), at right angles to the previous direction of the beam. The usual accelerating voltages, only small fractions of which are switched at the pulser, amount to between eight and twenty kilovolts. This process creates a ribbon-shaped secondary ion beam (14), which consists of individual, transverse, string-shaped ion packets. Each of these string-shaped ion packets is comprised of ions of the same mass. The string-shaped ion packets with light ions fly quickly; those with heavier ions fly more slowly. The direction of flight of this ribbon-shaped secondary ion beam (14) is between the previous direction of the primary ion beam and the direction of acceleration at right angles to this, because the ions retain their speed in the original direction of the primary ion beam (11). A time-of-flight mass spectrometer of this type is also usually operated with a Mamyrin energy-focusing reflector (15), which reflects the whole width of the ribbon-shaped secondary ion beam (14) with the string-shaped ion packets, focuses its energy spread, and directs it toward a flat detector (16). The width of the ion beam means the reflector must be operated with grids in order to generate a reflection field which is homogeneous across the width of the ion beam. Mass resolving powers of around R=40,000 at mass 1000 daltons are achieved in these OTOF mass spectrometers.

In a Mamyrin reflector, the ions are decelerated in a homogeneous electric field until they come to a standstill, and are then accelerated again to their original kinetic energy in the reverse direction. The standstill means that the tiniest electric field inhomogeneities have a very major effect on the ions; the generation of the field must therefore be very precise.

Faster ions penetrate slightly deeper into the reflector than slower ions of the same mass; they then obtain slightly more energy on their return journey and catch up with the slower ions precisely at the detector. This is how the velocity focusing works.

It is possible to use a reflector with a single field which is homogeneous throughout. In this case, the length of the reflection field must have a specific, accurately maintained ratio to the total length of the flight path. Since it is often very difficult to fulfill this condition, it is usual to use a shorter, two-part Mamyrin reflector. This comprises a first, relatively strong deceleration field, and then a second, significantly weaker reflection field, in which the ions are brought to a standstill and reflected. This two-part Mamyrin reflector is much easier to adjust electrically, since two voltages are used. In FIG. 1, the deceleration field is generated between the two grids (18) and (19).

As a rule, the Mamyrin reflectors are manufactured from parallel metal plates with large apertures, to which the increasing potentials are applied in the form of voltages. Voltage dividers made from precision resistors are usually used to maintain a potential which increases as uniformly as possible, and thus an electric field which is as homogeneous as possible. The number and spacings of the metal plates and the size of the apertures have been optimized over many years by the manufacturing companies. Thirty to forty of these plates are usually required. The metal plates should be manufactured with precision and also be mechanically strong in order to prevent bending, and particularly vibrations, which can be resonantly generated by rotating pumps and other exciters. In two-stage reflectors, the grids are held by two such plates. FIG. 2 shows part of a reflector which is constructed from simple plates. Insulating spacers (22) ensure the precise separations. The structure is firmly held together by insulating posts (23), which run through the interior of the spacers.

Some commercial time-of-flight mass spectrometers use metal plates whose edge is folded over in an L shape inside the reflector to shield against the ground potential penetrating through from the outside. Part of a reflector with such an arrangement is shown in FIG. 3. The arrangement looks very simple. However, since high mechanical precision is required, these plates with their folded edges are frequently machined from solid material, which means they cannot be manufactured at low cost. The number of plates and voltages can be reduced compared to the reflector in FIG. 2, but between twenty and thirty of these plates are nevertheless required for one reflector. The outer surfaces of the plates are used for the mounting.

Significant progress in reflector technology was achieved by moving the internal shielding edges, which can be seen in FIG. 3, further outwards. FIG. 4 shows that the potential in the interior is now essentially formed by the tabs (27), with the potential of the shielding edges penetrating to only a slight degree. The resolving power of a reflector with this structure is approximately ten to fifteen percent higher than that of a conventional reflector, as shown in FIG. 2 or 3.

In the current state of the art, it remains a challenge to generate a homogeneous deceleration and re-acceleration field in the interior of the reflector. At present, this has to be optimized with a time-consuming voltage adjustment step. There is therefore still a need for a reflector which is simple to manufacture with a high degree of precision and mechanical strength, and which provides an electric field in the interior which is as homogeneous as possible.

SUMMARY OF THE INVENTION

The present invention provides a reflector comprised of metal plates which have symmetric shielding edges that are set further back. The dipole field generated by these shielding edges penetrates only slightly through the plates into the interior of the reflector and provides a good shield against the potential of the surrounding recipient, which is at ground potential. If the mechanical design is precise, the resolving power of the time-of-flight mass spectrometer can increase by around a further fifteen percent compared to the best prior art. The mass resolution was optimized with the aid of computerized field simulations, and it has been possible to experimentally confirm its improvement.

The symmetric shielding edges can also be mounted on the outside of the plates and surround the plates like a frame. It is preferable to provide external lugs which allow the plates to be precisely positioned with respect to each other by means of insulating spacers.

DETAILED DESCRIPTION

Figure 1:
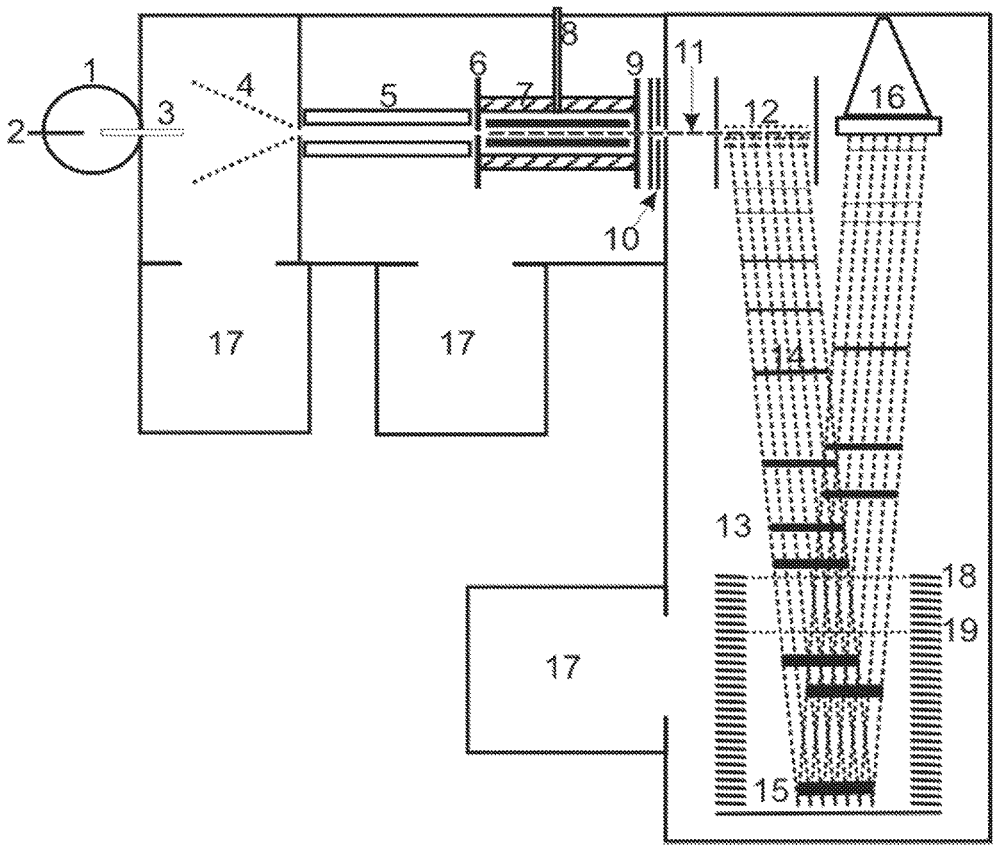
FIGURE 1 (PRIOR ART)
FIG. 1 shows a schematically simplified representation of an OTOF mass spectrometer which corresponds to the prior art, but in which a reflector according to the innovative design described here can be used.
Figure 2:
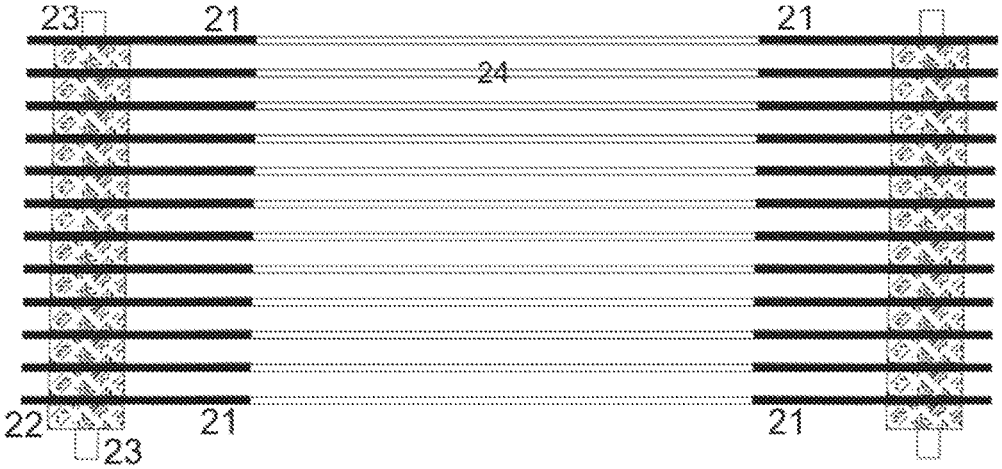
FIGURE 2 (PRIOR ART)
FIG. 2 shows part from a Mamyrin reflector according to the original prior art. The metal plates (21) are stacked closely (i.e., arranged in series one after the other) to largely prevent the ground potential of the surroundings from penetrating into the interior (24). The plates are kept apart by precisely formed spacers (22), made usually of ceramic, and held together by a post (23).
Figure 3:
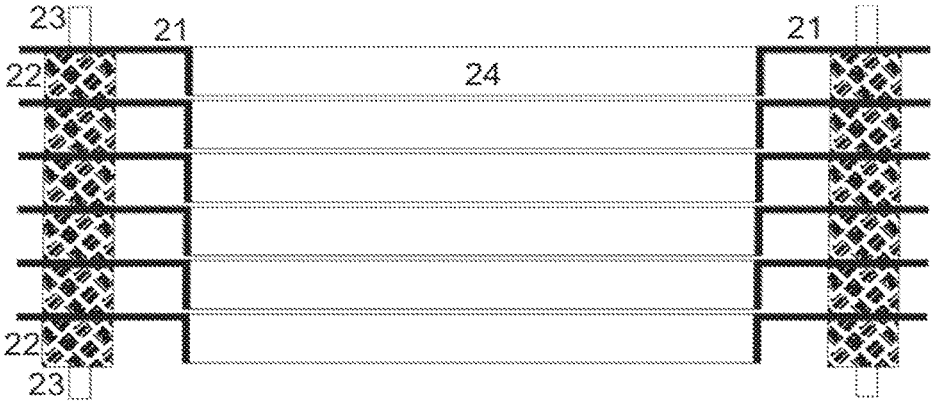
FIGURE 3 (PRIOR ART)
FIG. 3 depicts part of a similar Mamyrin reflector. Here the plates (21) are not stacked so closely, but equipped with inner shielding edges to shield against the external potential. The resolving power is hardly better than that of the arrangement in FIG. 2, but significantly fewer plates (21) are required.
Figure 4:
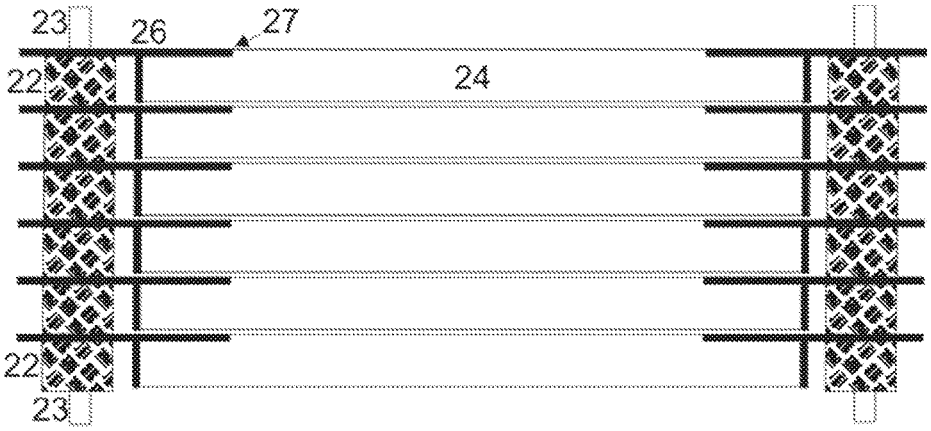
FIGURE 4 (PRIOR ART)
FIG. 4 depicts an embodiment which provides a resolving power which is around 10 to 15 percent better than with the embodiments in FIGS. 2 and 3. Here, the shielding edges of the metal plates (26) are set further back so that the potential in the interior (24) is essentially determined by the metal lugs (27). The potential in the interior has a smooth characteristic.

The present invention provides a reflector which has a simple design and offers an improved mass resolution. It may be part of a mass spectrometer like that shown in FIG. 1, for which ions are generated at atmospheric pressure in an ion source (1) with a spray capillary (2), and these ions are introduced into the vacuum system through a capillary (3). A conventional RF ion funnel (4) guides the ions into a first RF quadrupole rod system (5), which can be operated both as a simple ion guide and also as a mass filter for selecting a species of parent ion to be fragmented. The unselected or selected ions are fed continuously through the ring diaphragm (6) and into the storage device (7); selected parent ions can be fragmented in this process by energetic collisions. The storage device (7) has an almost gastight casing and is charged with collision gas through the gas feeder (8) in order to focus the ions by means of collisions and to collect them in the axis. Ions are extracted from the storage device (7) through the switchable extraction lens (9). This lens, together with the einzel lens (10), shapes the ions into a fine primary beam (11) and sends them to the ion pulser (12). The ion pulser (12) periodically pulses out a section of the primary ion beam (11) orthogonally into the high-potential drift region (13), which is the mass-dispersive region of the time-of-flight mass spectrometer, thus generating the new ion beam (14) each time. The ion beam (14) is reflected in the reflector (15) with second-order energy focusing, and is measured in the detector (16). The mass spectrometer is evacuated by the pumps (17). The reflector (15) represents a two-stage Mamyrin reflector in the example shown, with two grids (18) and (19), which enclose a first strong deceleration field, followed by a weaker reflection field. The velocity spread means that the linear bunches of ions widen out all the way into the reflector, but the velocity focusing causes them to be very finely refocused again up to the detector. This produces the high mass resolution.

Figure 5:
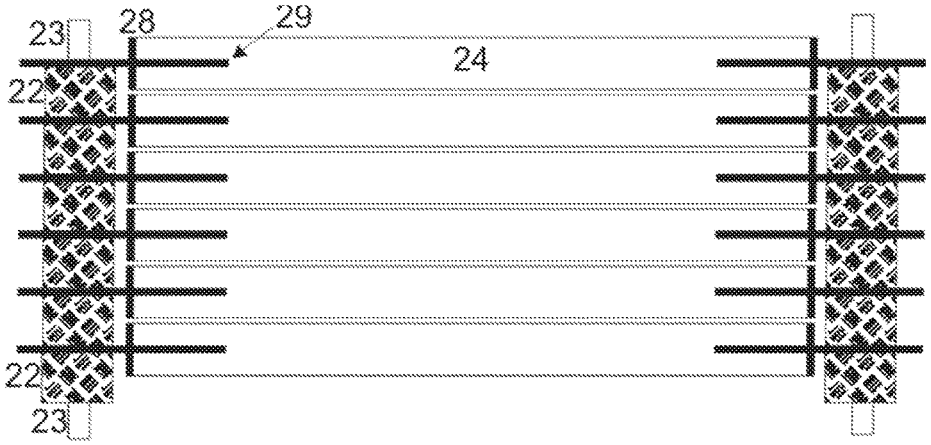
FIG. 5 depicts an embodiment according to principles of this invention. The set back shielding edges of the metal plates (28) are now arranged largely symmetrically to the plane of the plates and form dipoles between the plate lugs (29). The mass resolution can be increased by about a further 15 percent compared to the embodiment of FIG. 4.

Unlike prior art reflectors, the reflector of the present invention comprises metal plates whose symmetric shielding edges are set further back, as depicted in FIG. 5 for part of the reflector, by way of example. The dipole field formed by these shielding edges and the surrounding recipient, which is at ground potential, penetrates to a lesser extent through the plates into the interior of the reflector than is the case with previous embodiments. The improvement in the resolving power was optimized by field simulations on a computer, and it has been possible to confirm this experimentally. When the mechanical design is sturdy and precise, the resolving power of the time-of-flight mass spectrometer is increased by around a further 15 percent compared to the best prior art to date.

Figure 6:
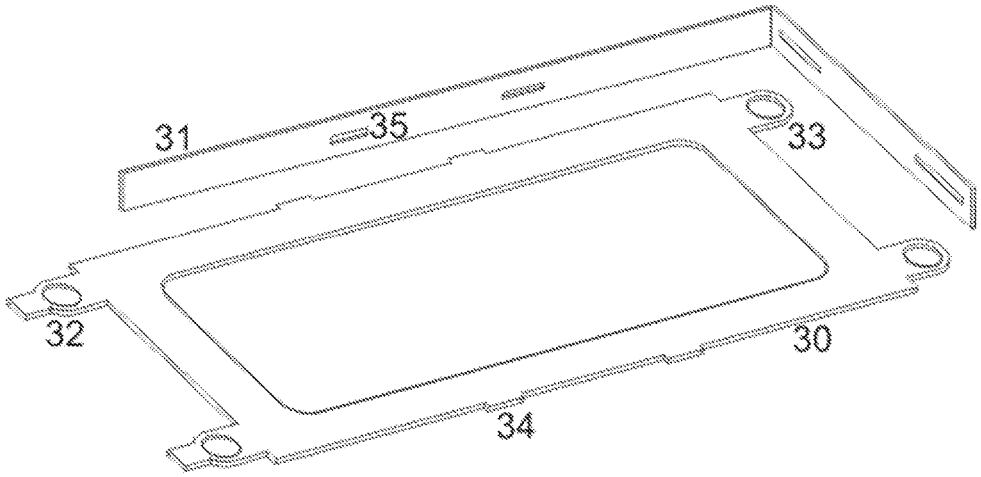
FIG. 6 depicts the simple way they are manufactured from a base plate (30) and two angle plates (31), of which only one is shown for the sake of clarity. In a preferred embodiment, all the plates are laser cut to avoid any warping or burring. After they have been assembled, the edges and insertion lugs can be laser welded; this produces a structure which is extremely torsion-resistant.
Figure 7:
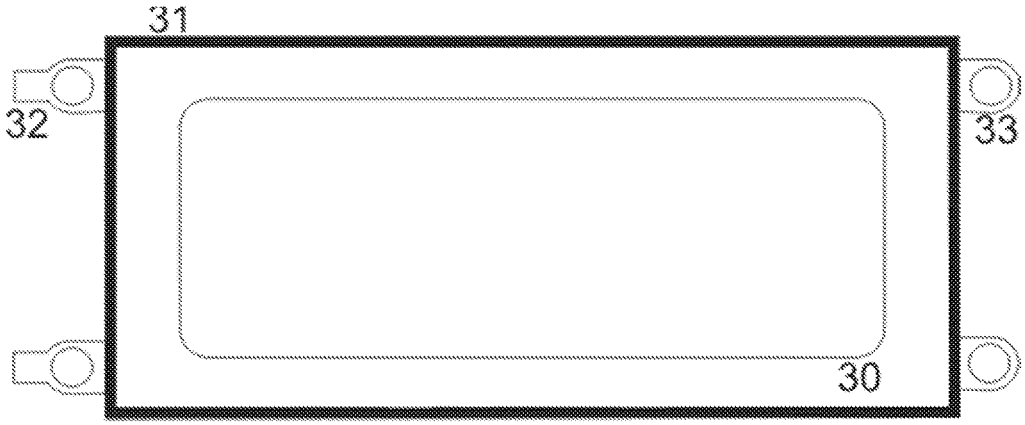
FIG. 7 shows the structure of an embodiment of a plate (30) in plan view (with the two angle plates 31; thick black outline).

FIG. 6 shows the structure and production of the reflector plates according to FIG. 5 in an example embodiment. The manufacture of a base plate (30) and two angle plates (31), of which only one is visible for reasons of clarity, is relatively simple and very low cost compared to machining them from solid material. In one embodiment, the base plates (30) and the angle plates (31) are laser cut very precisely with computer control from very flat sheet material around one millimeter thick in order to prevent any warping or the formation of burr at the edges. They are relatively easy to put together thanks to the locating tabs (32) and (33) and the insertion lugs (34), which fit through the precisely shaped apertures (35). After they have been put together, the angle plates and insertion lugs can be fixed to each other by laser welding, which results in a very torsion-resistant structure. In the example shown, the locating tabs have circular openings to hold spacers, which are made of ceramic, or other suitable insulating material. They position the reflector plates very precisely with respect to each other.

The drawing in FIG. 6 does not show the example embodiment in fine detail. The potential plates (30) are relatively thick, at 1 mm, in order to give the necessary mechanical strength. Consequently, a large number of surfaces abutting one another are created between the narrow edges of these plates (30) and the angle plates (31), and these can be difficult to evacuate. One skilled in the art will recognize, however, that pumpable gaps can be formed between the narrow edges of the potential plates (30) and the angle plates (31) by specially forming the contour of the potential plates (30).

The person skilled in the art will find it easy to develop further interesting embodiments based on the devices for the reflection of ions according to the invention. These shall also be covered by this patent application to the extent that they derive from this invention.

The invention claimed is:

1. A reflector for a time-of-flight mass spectrometer in which approaching ions are decelerated and re-accelerated by electric fields, the reflector comprising a plurality of apertured potential plates having inward-protruding narrow plate lugs and being arranged substantially parallel to one another and separated by insulating spacers in a first direction, wherein an electric field in an interior of the reflector is formed substantially by the narrow plate lugs, and wherein each potential plate has a symmetric shielding edge that extends symmetrically in the first direction to both sides of the narrow plate lug of that potential plate at a predetermined distance from an interior of the reflector.

2. The reflector according to claim 1, wherein the potential plates are manufactured from planar metal plates.

3. The reflector according to claim 2, wherein the potential plates are laser cut from the metal plates.

4. A reflector for a time-of-flight mass spectrometer in which approaching ions are decelerated and re-accelerated by electric fields, the reflector comprising a plurality of apertured potential plates arranged substantially parallel to one another and separated by insulating spacers in a first direction, wherein each potential plate has a symmetric shielding edge that extends symmetrically in the first direction to both sides of the potential plate at a predetermined distance from an interior of the reflector, and wherein each potential plate comprises a metal base plate with tabs extending therefrom and two angle plates with openings through which the tabs pass such that the angle plates reside adjacent to an outer edge of the base plate and extend in a substantially perpendicular direction to form the shielding edge.

5. The reflector according to claim 4, wherein the tabs of a potential plate are integral with and parallel to the base plate and the openings in the angle plates comprise slits within which the tabs reside such that the potential plates are positioned and mechanically stabilized thereby.

6. The reflector according to claim 1, wherein the spacers which electrically insulate the potential plates from one another are located to a side of the shielding edges away from the apertures of the potential plates.

7. The reflector according to claim 1, wherein a single, continuously homogeneous field is generated by the potential plates.

8. The reflector according to claim 1, wherein the potential plates generate a first, relatively strong deceleration field region that reduces the speed of approaching ions, and a second, much weaker reflection field region that brings the ions to a standstill and reflects them.

9. The reflector according to claim 1, wherein an electric circuit of the potential plates comprises voltage dividers made of precision resistors in order to achieve a potential which increases as uniformly as possible from plate to plate.

10. A time-of-flight mass spectrometer having a reflector according to claim 1.

11. The mass spectrometer according to claim 10, wherein the potential plates are manufactured from planar metal plates.

12. The mass spectrometer according to claim 11, wherein the potential plates are laser cut from the metal plates.

13. The mass spectrometer according to claim 11, wherein each potential plate comprises a metal base plate with tabs extending therefrom and two angle plates with openings through which the tabs pass such that the angle plates reside adjacent to an outer edge of the base plate and extend in a substantially perpendicular direction to form the shielding edges.

14. The mass spectrometer according to claim 13, wherein the tabs of a potential plate are integral with and parallel to the base plate and the openings in the angle plates comprise slits within which the tabs reside such that the potential plates are positioned and mechanically stabilized thereby.

15. The mass spectrometer according to claim 10, wherein the spacers which electrically insulate the potential plates from one another are located to a side of the shielding edges away from the apertures of the potential plates.

16. The mass spectrometer according to claim 10, wherein a single, continuously homogeneous field is generated by the potential plates.

17. The mass spectrometer according to claim 10, wherein the potential plates generate a first, relatively strong deceleration field region that reduces the speed of the approaching ions, and a second, much weaker reflection field region that brings the ions to a standstill and reflects them.

18. The mass spectrometer according to claim 10, wherein an electric circuit of the potential plates comprises voltage dividers made of precision resistors in order to achieve a potential which increases as uniformly as possible from plate to plate.

19. A reflector for a time-of-flight mass spectrometer in which approaching ions are decelerated and re-accelerated by electric fields, the reflector comprising a plurality of apertured potential plates arranged substantially parallel to one another and separated by insulating spacers in a first direction, wherein each potential plate has a symmetric shielding edge that extends symmetrically in the first direction to both sides of the potential plate at a predetermined distance from an interior of the reflector, and wherein each potential plate comprises a metal base plate having insertion lugs extending therefrom and further comprises peripheral plates having apertures through which the insertion lugs pass and being aligned perpendicularly with the metal base plate, whereby the peripheral plates form the symmetric shielding edge around the metal base plate.

20. The reflector according to claim 19, wherein the insertion lugs of the metal base plate are fixed to the peripheral plates in the apertures by laser welding to produce a torsion-resistant structure.

* * * * *